US012504253B2

(12) United States Patent
Martire et al.

(10) Patent No.: US 12,504,253 B2
(45) Date of Patent: Dec. 23, 2025

(54) LAUNCH ACCELERATION SYSTEM

(71) Applicant: Applied Physics, Inc., New York, NY (US)

(72) Inventors: Gianni Martire, New York, NY (US); David Morgan Wirth, San Diego, CA (US)

(73) Assignee: Applied Physics, Inc., New York, NY (US)

( * ) Notice: Subject to any disclaimer, the term of this patent is extended or adjusted under 35 U.S.C. 154(b) by 13 days.

(21) Appl. No.: 18/427,208

(22) Filed: Jan. 30, 2024

(65) Prior Publication Data

US 2024/0426569 A1 Dec. 26, 2024

Related U.S. Application Data

(60) Provisional application No. 63/442,236, filed on Jan. 31, 2023.

(51) Int. Cl.
*F41B 6/00* (2006.01)

(52) U.S. Cl.
CPC ..... *F41B 6/003* (2013.01)

(58) Field of Classification Search
CPC ..... F41B 6/00; F41B 6/003; F41B 6/006
USPC ..... 89/8
See application file for complete search history.

(56) References Cited

U.S. PATENT DOCUMENTS 4,432,333 A * 2/1984 Kurherr ..... F41B 6/00 89/8
2004/0255767 A1* 12/2004 Frasca ..... F41B 6/003 89/8
2017/0237329 A1* 8/2017 Chen ..... H02K 41/0352 310/12.07

* cited by examiner

*Primary Examiner* — Samir Abdosh
(74) *Attorney, Agent, or Firm* — Cognition IP, P.C.; Edward Steakley; Justin White

(57) ABSTRACT

A launch acceleration system can include a passage, a plurality of magnetic components, and a control system. The passage can include an entry region, a projectile acceleration pathway, and an exit region for a moving projectile having a magnetically susceptible portion. The magnetic components can be arranged around the projectile acceleration pathway such that the moving projectile travels through the magnetic components. The control system can be coupled to the magnetic components and can be configured to actuate the \magnetic components at one or more proper times to facilitate one or more applications of magnetic force from the magnetic components to the moving projectile as the moving projectile passes through the projectile acceleration pathway in a manner that accelerates the moving projectile.

20 Claims, 4 Drawing Sheets

LAUNCH ACCELERATION SYSTEM

CROSS-REFERENCE TO RELATED APPLICATIONS

This application claims the benefit of U.S. Provisional Patent Application No. 63/442,236, filed Jan. 31, 2023, and titled "LAUNCH ACCELERATION SYSTEM," which application is also hereby incorporated by reference in its entirety herein.

TECHNICAL FIELD

The present disclosure relates generally to launch systems, and more particularly to increased acceleration of launched objects.

BACKGROUND

Humanity appears to be nearing the true beginnings of expansion into space. This requires advanced propulsion and launch technologies, but the contemporary space launch landscape is still dominated by rocket-based propulsion systems. Unfortunately, rockets tend to be expensive, complex, and have very strict system tolerances that make rapid reusability very difficult. Additionally, launching rockets requires incredibly large amounts of cryogens, fuel, and other toxic chemicals. This is the result of high thrust-to-mass requirements to lift a meaningful amount of payload into space.

One example of launch mechanisms that do not rely on burning excessive amounts of rocket fuel and other propulsions involve kinetic launch systems that spin a payload or other projectile to high rotational velocities and then release the payload or projectile as it exits through a tube. Current extant systems cannot reach earth-orbit altitudes, however, such that these kinetic type systems can benefit from further augmentation to reach their full potential.

Although traditional ways of launching projectiles have worked well in the past, improvements are always helpful. In particular, what is desired are launch systems having improved accelerations beyond those of previously known systems.

SUMMARY

It is an advantage of the present disclosure to provide launch systems having improved accelerations beyond those of previously known systems. The disclosed features, apparatuses, systems, and methods relate to the increased acceleration of launched payloads or other projectiles, and can be included within an overall launch system that involves a separate initial launch component in some arrangements. Advantages of the disclosed systems and methods can involve the use of a supplemental launch acceleration system that receives a moving projectile and accelerates it further by way of controlled magnetic forces.

In various embodiments of the present disclosure, a system configured to accelerate a moving projectile can include a passage, a plurality of magnetic components, and a control system. The passage can include an entry region, a projectile acceleration pathway, and an exit region. The passage, which can include a walled structure, can be configured to accept a moving projectile therein at the entry region, allow travel of the moving projectile therethrough along the projectile acceleration pathway, and expel the moving projectile therefrom at the exit region. The moving projectile can have at least one magnetically susceptible portion. The plurality of magnetic components can be arranged around the projectile acceleration pathway such that the moving projectile travels through the plurality of magnetic components. The control system can be coupled to the plurality of magnetic components and can be configured to actuate the magnetic components at one or more proper times in order to facilitate one or more applications of magnetic force from the magnetic components to the moving projectile as the moving projectile passes through the projectile acceleration pathway in a manner that accelerates the moving projectile.

In various detailed embodiments, the passage can be in the shape of a tube and the projectile acceleration pathway can extend through the tube. The plurality of magnetic components can form multiple sets of coils around the tube. Also, the projectile acceleration pathway can form a straight line. In some arrangements, the plurality of magnetic components can form a multistage induction coil gun around the passage, while in other arrangements the plurality of magnetic components can form a multistage repulsion coil gun around the passage. The control system can also be configured to actuate the plurality of magnetic components in a manner that centers the moving projectile within the passage as the moving projectile travels along the projectile acceleration pathway.

In various further detailed embodiments, the system can also include a powering component configured to provide power to the plurality of magnetic components. Such a powering component can derive power from a separate component that imparts an initial velocity on the moving projectile prior to the moving projectile entering the passage. Also, the passage can be configured to have a vacuum therein when the moving projectile passes therethrough. In some arrangements, the at least one magnetically susceptible portion can be formed from a copper, high purity aluminum, or calcium metal material. The moving projectile can include an inner region configured to hold a payload therein, and such an inner region can be magnetically shielded from the plurality of magnetic components. Also, the control system can be configured to switch power on and off rapidly to the plurality of magnetic components based on the exact location of the moving projectile in the passage. The control system can include sensing components, switching components, and power components. Such sensing components can be configured to detect the exact location and velocity of the moving projectile.

In various further embodiments of the present disclosure, methods of accelerating a moving projectile are provided. Pertinent process steps can include accepting the moving projectile, facilitating travel of the moving projectile, actuating a plurality of magnetic components, and accelerating the moving projectile using the actuated magnetic components. The moving projectile can be accepted into an entry region of a passage having a projectile acceleration pathway. Travel of the moving projectile can be facilitated through the passage along the projectile acceleration pathway. The plurality of magnetic components can be arranged around the projectile acceleration pathway, and actuation of the magnetic components can take place while the moving projectile travels along the projectile acceleration pathway. Accelerating the moving projectile using the actuated magnetic components can take place while the moving projectile travels along the projectile acceleration pathway.

In various detailed embodiments, accelerating the moving projectile can involve imparting a magnetic repulsion force from the magnetic components to a magnetically susceptible portion of the moving projectile. Further process steps can include detecting the location of the moving projectile while the moving projectile is within the passage, as well as centering the moving projectile within the passage using the actuated magnetic components. In addition, facilitating travel of the moving projectile through the passage can involve preventing contact between the moving projectile and the passage.

Other apparatuses, methods, features, and advantages of the disclosure will be or will become apparent to one with skill in the art upon examination of the following figures and detailed description. It is intended that all such additional apparatuses, methods, features and advantages be included within this description, be within the scope of the disclosure, and be protected by the accompanying claims.

BRIEF DESCRIPTION OF THE DRAWINGS

The included drawings are for illustrative purposes and serve only to provide examples of possible structures, arrangements, and methods for increasing the acceleration of launched payloads or other projectiles. These drawings in no way limit any changes in form and detail that may be made to the disclosure by one skilled in the art without departing from the spirit and scope of the disclosure.

DETAILED DESCRIPTION

Figure 1:
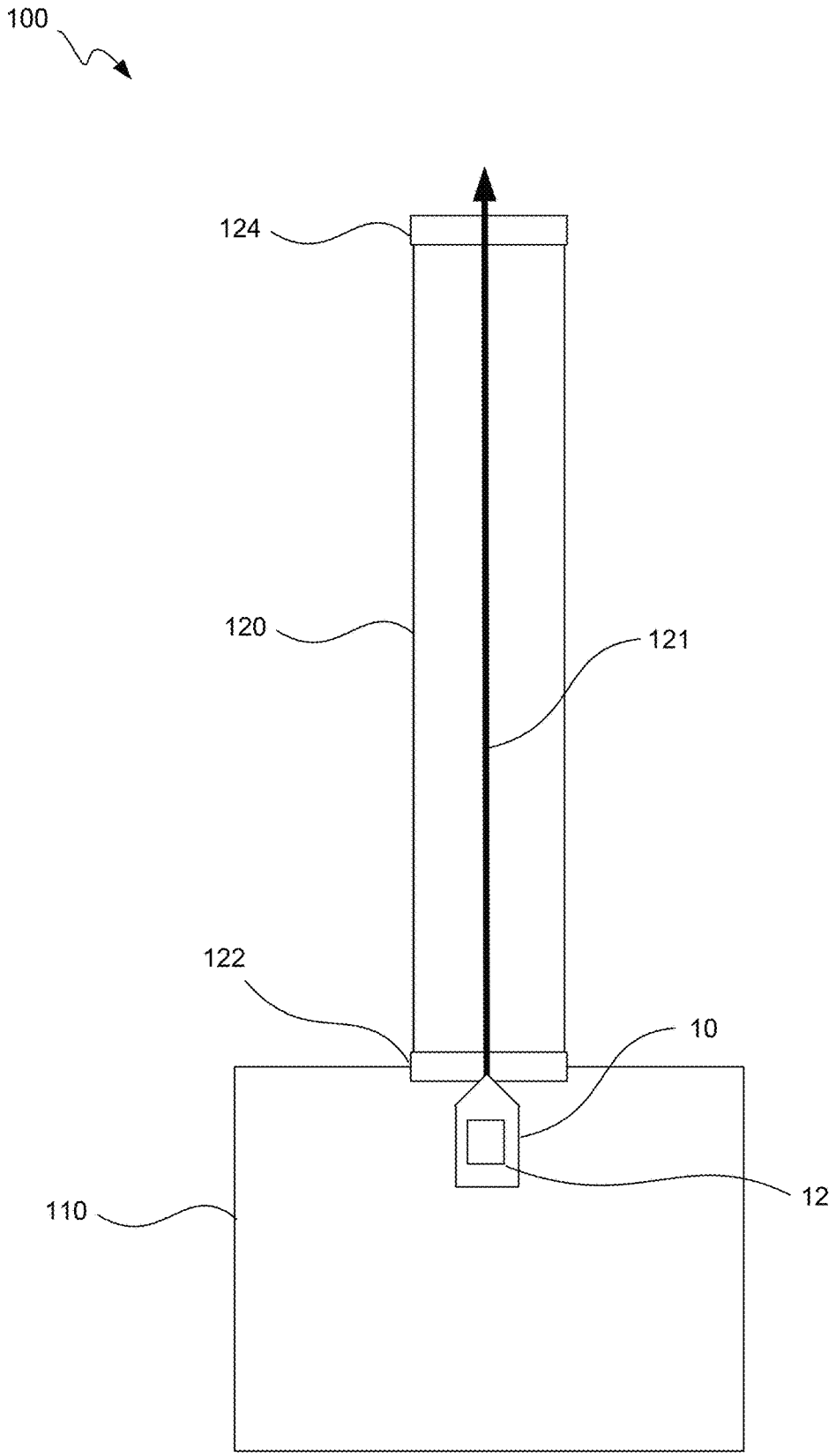
FIG. 1 illustrates in schematic view an example overall launch system according to one embodiment of the present disclosure.

Exemplary applications of apparatuses, systems, and methods according to the present disclosure are described in this section. These examples are being provided solely to add context and aid in the understanding of the disclosure. It will thus be apparent to one skilled in the art that the present disclosure may be practiced without some or all of these specific details provided herein. In some instances, well known process steps have not been described in detail in order to avoid unnecessarily obscuring the present disclosure. Other applications are possible, such that the following examples should not be taken as limiting. In the following detailed description, references are made to the accompanying drawings, which form a part of the description and in which are shown, by way of illustration, specific embodiments of the present disclosure. Although these embodiments are described in sufficient detail to enable one skilled in the art to practice the disclosure, it is understood that these examples are not limiting, such that other embodiments may be used, and changes may be made without departing from the spirit and scope of the disclosure.

The present disclosure relates in various embodiments to features, apparatuses, systems, and methods for increasing the acceleration of launched payloads or other moving projectiles. The disclosed embodiments can involve supplementing an existing initial launch component or system, such as by adding a separate launch acceleration system. In various arrangements, such a launch acceleration system can provide additional acceleration for payloads that have already been launched by an initial launch component. The launch system can include a tube containing magnetic acceleration coils, a rechargeable energy storage system that provides a rapid discharge over the times needed to accelerate the payload, and one or more modifications to the payload or other already moving projectile that facilitates its acceleration by the magnetic fields produced by the acceleration coils.

The disclosed systems can be used to increase the reach of existing launch systems, such as those including kinetic launch mechanisms, for example, without requiring the drastic mass increases required by typical rocket systems. The disclosed launch acceleration systems can involve the use of an acceleration tube and an applied magnetic field to accelerate a payload or other projectile traveling along its length. The use of magnetic forces means that the payload itself need not carry fuel, as the disclosed tube system can supply added energy to accelerate the mass. In some arrangements, the disclosed launch cadence may only be limited by the time required to charge capacitor banks that supply power the magnetic coils, which can be a great improvement to the recovery, maintenance, and refueling of conventional rocket systems.

Although various embodiments disclosed herein discuss launch acceleration systems or "booster systems" involving magnetic coils wrapped around a straight tube, it will be readily appreciated that the disclosed features, apparatuses, systems, and methods can similarly be with any suitable substitutes or alternatives. Similarly, any other form of boosting the acceleration or exit velocity of a payload or other projectile or object launched by an initial launch system may also be used. Other applications, arrangements, and extrapolations beyond the illustrated embodiments are also contemplated.

Referring first to FIG. 1, an example overall launch system is illustrated in schematic view. Overall launch system can include an initial launch source 110 configured to launch a payload or other projectile 10 into a launch acceleration system 120 where the projectile is then accelerated further along a projectile acceleration pathway 121 to an increased velocity before exiting the system. Projectile 10 can include at least one magnetically susceptible portion 12, can enter launch acceleration system 120 at an entry region 122, and can exit the launch acceleration system at an exit region 124.

Initial launch source 110 (which can also be called a primary launch system) can be any suitable launch source, such as, for example, a separate kinetic launch system, catapult, rail gun, gas gun, cannon, or other mechanical launch system, as well as a rocket or other propulsion launch system in some arrangements. In various particular embodiments, initial launch source 110 can be a vacuum-centrifuge that releases a payload or other moving projectile at a precise angle that corresponds to an exit port thereof that corresponds to an entry region 122 of a separate launch acceleration system 120. In some arrangements, initial launch source 110 can be any means of providing acceleration to a mass that is insufficient or impractical to accelerate a desired payload mass to a desired payload velocity, such that a launch acceleration system 120 or other auxiliary booster system is desirable. In various embodiments, the overall launch system including the initial launch source can be provided, while other embodiments can be limited to the launch acceleration system itself.

Figure 2:
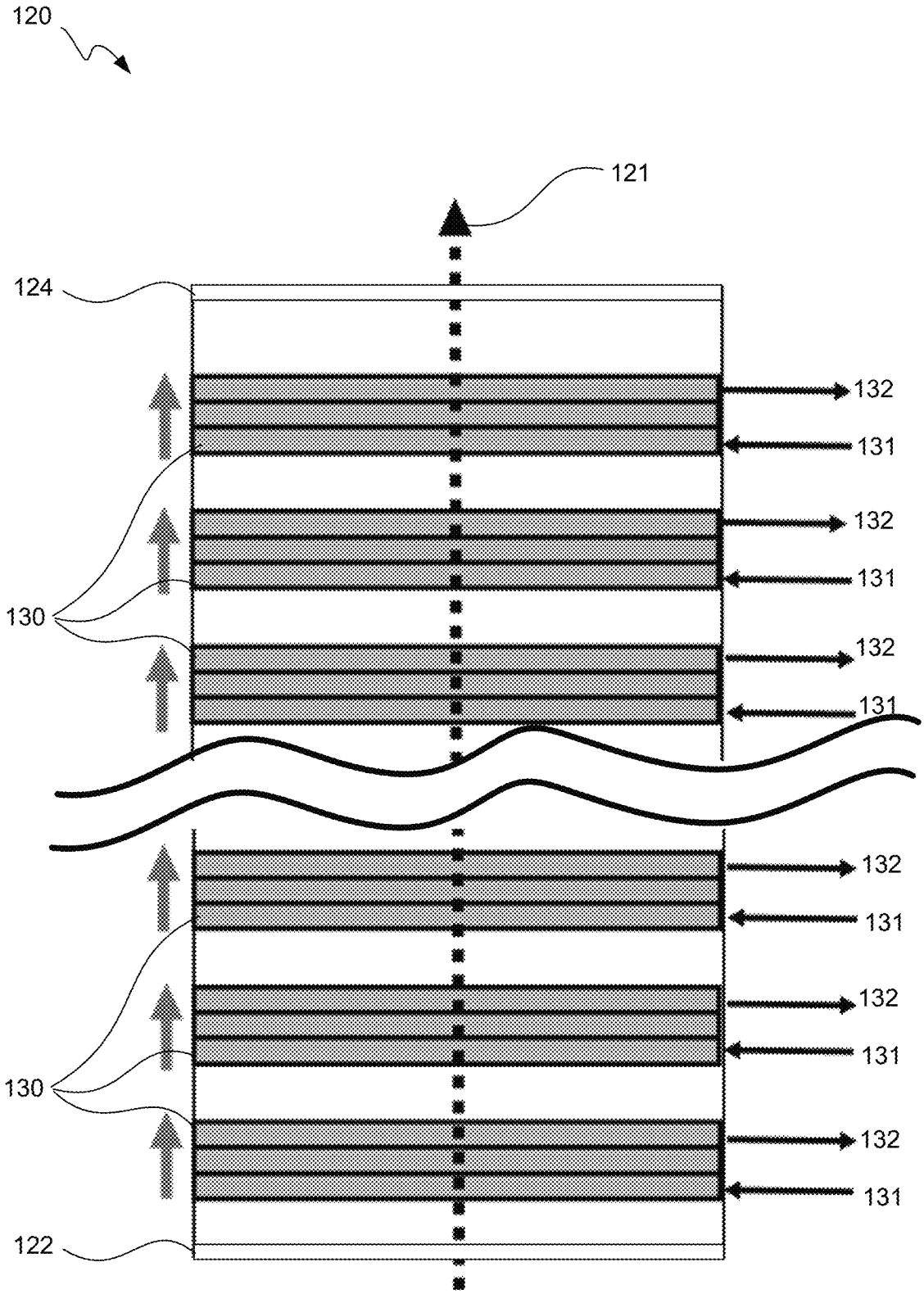
FIG. 2 illustrates in schematic view an example launch acceleration system according to one embodiment of the present disclosure.

Continuing with FIG. 2, an example launch acceleration system is shown in schematic view. Launch acceleration system 120 can generally form a system configured to accelerate a moving projectile, and can include a passage, a plurality of magnetic components 130, and a control system coupled to the magnetic components. The passage can be internal within a tube, for example, and can include an entry region 122, a projectile acceleration pathway 121, and an exit region 124. The passage (e.g., acceleration tube) can be configured to accept a moving projectile (e.g., projectile 10 above) at entry region 122, can allow travel of the moving projectile along projectile acceleration pathway 121, and expel the moving projectile at exit region 124. Launch acceleration system 120 can form an elongated tube and can be substantially longer than that which is shown for purposes of illustration in FIG. 2.

Magnetic components 130 can be arranged around the projectile acceleration pathway 121 such that the moving projectile travels through the magnetic components. In some arrangements, magnetic components 130 can form a plurality of coils wrapped around the passage, which again can be in the shape of a tube. Such a tube can be straight, such that the projection acceleration pathway 121 lies along a straight line. Magnetic components 130 can be separate sets of coils forming different stages of coils. While six such stages or sets of coils are shown in FIG. 2 for purposes of illustration, it will be readily understood that the length of launch acceleration system 120 can be extended to include many more such sets of magnetic components 130. In various arrangements, power can be provided to one or more sets of magnetic components 130 at power inlets 131 and can exit at one or more power outlets 132. Each separate set of magnetic components 130 can be powered independently in order to maximize the magnetic forces imparted onto the projectile traveling therethrough.

Accordingly, a control system coupled to the plurality of magnetic components 130 can be configured to actuate the plurality of magnetic components at one or more proper times in order to facilitate one or more applications of magnetic force from the magnetic components to the moving projectile as the moving projectile passes through the projectile acceleration pathway 121 in a manner that accelerates the moving projectile. Various aspects of such a control system are provided in greater detail below.

It will be readily appreciated that the disclosed launch acceleration systems (i.e., booster systems) can be used for a variety of different applications. For example, the disclosed launch acceleration system can be used in general ground-based launch systems. While one purpose of the disclosed systems is to provide additional acceleration, these systems can be also used as standalone systems in some ground-based launch arrangements. For example, the disclosed systems can be used to gain velocities at low altitudes, such as where the systems can be used as a supplement to a catapult, railgun, or other mechanical system. For some rocket applications, alternatively, the disclosed systems can be used to provide initial acceleration to reduce subsequent rocket fuel consumption.

As another example, the disclosed systems can involve some applications having additional benefits when assembled for use on other planets, moons, asteroids, or other objects in the solar system. In such environments, the disclosed systems can have advantages over typical rocket propulsion systems in that these systems only require electricity rather than fuel that may be unavailable at such remote locations. Furthermore, reusability and the possibility to charge on-site remotely, for example, through solar power, may significantly reduce operation costs. As yet another application example, the disclosed systems can also be scaled for use on any projectile acceleration device, such as kinetic weapons, firearms, cannons, artillery, and the like. The disclosed launch acceleration system can be adapted to be fixed on the end of kinetic launch hardware to increase the exit velocity of projectiles through the disclosed techniques.

Figure 3:
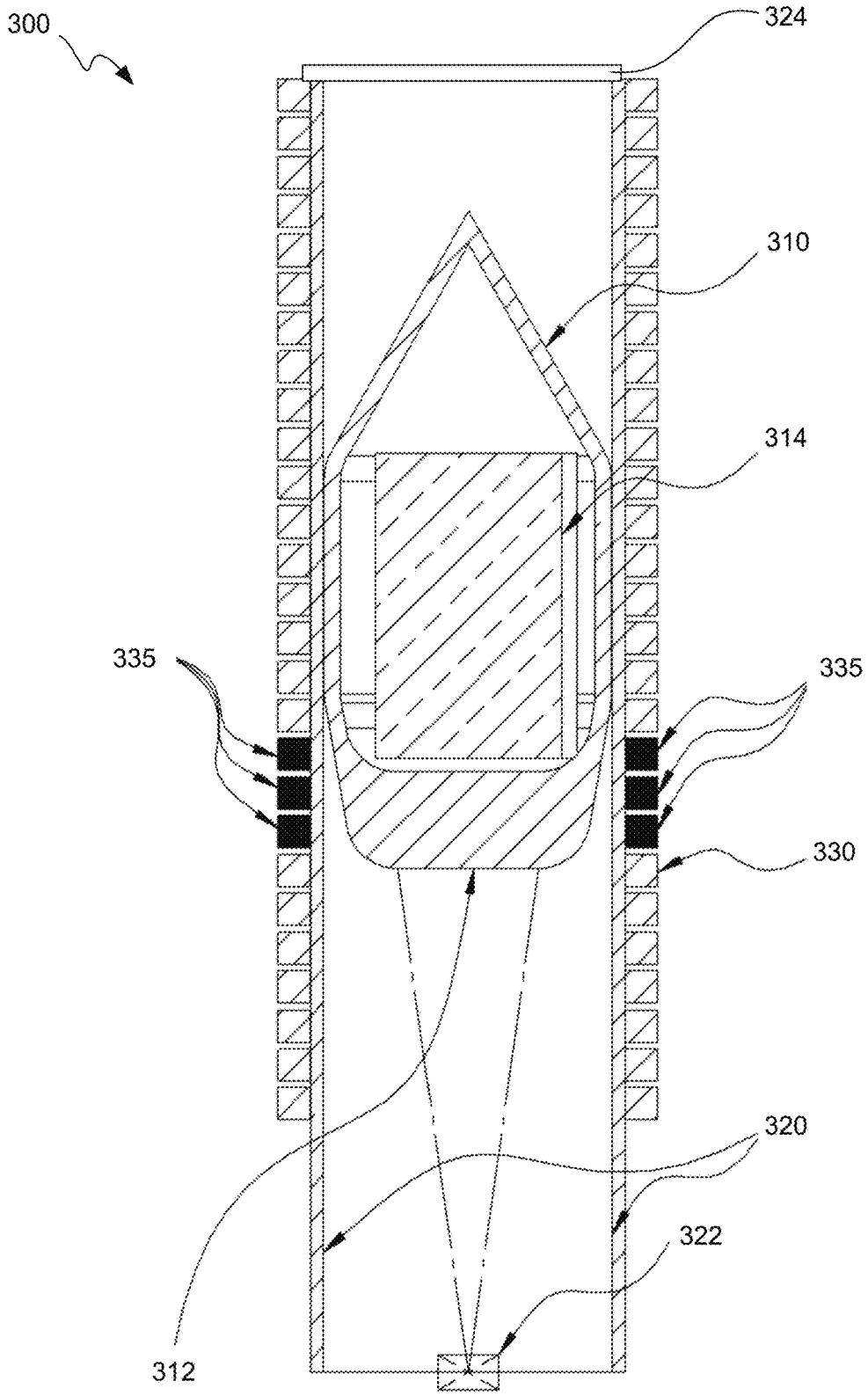
FIG. 3 illustrates in side cross-section view an example launch acceleration system with a moving projectile therein according to one embodiment of the present disclosure.

Moving next to FIG. 3, an example launch acceleration system with a moving projectile therein is illustrated in side cross-section view. Launch acceleration system 300 can be similar in some regards to launch acceleration system 120 above. Launch acceleration system 300 can be a system configured to accelerate a moving projectile, and can include a passage, magnetic components, and a control system. The passage can be within an acceleration tube defined by tube walls 320, an entry region 322, and an exit region 324. A projection acceleration pathway can extend through acceleration tube 320 from the entry region 322 to the exit region 324 and can be configured to facilitate the passage of a moving projectile 310. This moving projectile 310 can include a magnetically susceptible portion 312, and a shielded portion 314 that is configured to magnetically shield an internal payload located therewithin. Multiple sets of magnetic coils 330 can be actuated separately by a control system in a timed manner that facilitates acceleration of the moving projectile 310 due to interaction with the magnetically susceptible portion 312.

For example, a set of actuated magnetic coils 335 can be actuated at just the right time to provide a magnetic force to magnetically susceptible portion 312 just as that portion passes by the actuated coils. This can then result in a magnetic repulsion force that pushes the magnetically susceptible portion 312 away and thus imparts acceleration onto the moving projectile 310. By actuating each separate set of magnetic coils 330 at just the right time with respect to the relative location of the magnetically susceptible portion and the magnetic coils, this can then result in an increase in acceleration for the projectile 310 for each set of magnetic coils. In some arrangements a magnetic repulsion force can be used, in some arrangements a magnetic attraction force can be used, and in some arrangement both types of magnetic forces can be used depending on the actuation timing, power application, and location and velocity of the moving projectile 310 within the acceleration tube 320.

Various details and subsystems of the disclosed launch acceleration systems (i.e., booster systems) will now be provided. As noted above, a launch acceleration or booster system can include an acceleration tube, the outside of which is fitted with one or more coils of wire forming one or more solenoids, the magnetic fields of which may be dynamically switched on or off via signals from control electronics and are powered by a power supply. In various arrangements, these solenoid coils may be passively or actively cooled with air, liquid, or cryogenic liquid to achieve a lower resistance. These coils may be potted in a high strength insulative polymer or ceramic compound to provide added strength against coil contraction or expansion during acceleration. Coils may be wrapped with high strength fibers, such as Kevlar, fiberglass, carbon fiber, basalt, boron, Vectran, or other suitable material(s) so as to further improve resistance to hoop stresses during acceleration.

In some alternative embodiments, the acceleration tube can include a Lorentz-force accelerator (e.g., rail gun) where mutually orthogonal current and magnetic field can be applied across the payload or other moving projectile in a direction perpendicular to its motion. In such arrangements, physical contact may be needed to facilitate current, which may limit the types of payloads that can be accelerated. Alternatively, current may flow without physical contact where a plasma discharge can be achieved in the acceleration tube. In yet another alternate embodiment, a gas-based gun may be alternatively used to provide propulsion. In such a non-magnetic system, a powerful jet can be produced by rapidly compressing a large volume of gas, for example, through an explosion and directing a narrow exhaust at the projectile.

In various embodiments interfacing with a vacuum-centrifuge-type initial launch source, the acceleration tube consists of a number of conductive wire coils wrapped around a tube extending from the exit port through which the payload will travel once it has been released from the centrifuge mechanism of the initial launch source. Such conductive wire coils can be formed from copper, silver, high purity aluminum, or any other suitably conductive material as known to those of ordinary skill in the state of the art. In such embodiments, the payload or other projectile can travel at a velocity of greater than 340 m/s within a vacuum environment. Also, the acceleration tube can have an inner diameter that can be as close as possible to the outer diameter of the payload or projectile since it increases system efficiencies for the current-carrying coils to be as close as possible to the payload or projectile inside the passage.

In various embodiments, the acceleration tube can be fashioned from a non-conductive polymer composite material such as fiberglass-reinforced composite polymer, Kevlar-reinforced fiberglass composite polymer, or cermet material, for example. In some embodiments, the acceleration tube can fashioned from carbon-fiber reinforced composite ("CFRP") material. In some arrangements, a polymer material of the composite acceleration tube can be a polybismalemide, poly-benzimidazole, poly-sulfone, polyimide, poly-carbonate, or poly-amide type polymer, and/or other conductive materials known to those of ordinary skill in the art. In some embodiments, a polymer material of the composite acceleration tube can be a poly-urethane-urea thermoset, poly-urea thermoset, epoxide thermoset, or phenol-formaldehyde thermoset polymer. In some arrangements, the inner surface of the tube can be coated with a thin layer of polytetrafluoroethylene or other perfluorinated or polyfluorinated polymer.

In various embodiments, a solid copper or high-purity aluminum wire with a thin layer of high strength and thermally stable polymer insulation can be wrapped around the acceleration tube to form a primary drive coil. Such a wire can be wrapped until the section of tube covered by the wire is approximately the length of the current carrying axial length of the payload or moving projectile. In some arrangements, the wire can be wrapped to form multiple layers whereby the section of tube covered by the contiguous wire can still be approximately the length of the current carrying axial length of the payload or projectile. Each layer of the primary drive coil can be wrapped with reinforcement (such as Kevlar, fiberglass, carbon fiber, basalt, boron, Vectran, or other material) and/or potted with polymer or ceramic filler prior to wrapping subsequent layers. In some arrangements, a high-gauge wire (e.g., small diameter wire relative to the primary drive coil) can be wrapped around the acceleration tube to form a sensor coil prior to wrapping the primary drive coil over the top of it. Alternatively, a ferromagnetic rod can be placed radially with respect to the acceleration tube and the sensor coil can be wrapped around the rod.

In some arrangements, several primary drive coils and sensor coils can be wrapped around the acceleration tube thereby forming a sequence of primary drive coils. In some arrangements, a cooling jacket can be fashioned around the coils to provide liquid or cryogenic cooling. Alternatively, the wires can be hollow cored and coolant can be flowed axially through the wires of the primary drive coils. In some arrangements, sensor coils can be omitted and a high speed GHz radar telemetry system can be fashioned at the top or relative bottom of the acceleration tube to track projectile position. In alternative embodiments, telemetry can be provided by a laser, a light emitting diode, a maser, or any other suitable high speed electromagnetic feedback system. In some arrangements, one or more coils can be wrapped around the acceleration tube and augmented by any cooling or sensing systems, can then be reinforced with any suitable reinforcement (such as Kevlar, fiberglass, carbon fiber, basalt, boron, Vectran, or other material), and/or can be potted with polymer or ceramic filler once the final layer has been wrapped. In some alternate embodiments, an external superconducting solenoid with a cryogenic cooling vessel can be wrapped around all primary drive coils to provide a constant external field that is counteracted by the primary drive coils opposing axial direction fields to impart an alternate method of acceleration. Alternatively, the system can be modular and the acceleration coils may be individually replaced when damage occurs.

In various embodiments, one or more modifications can be made to the payload or moving projectile. In some arrangements, the payload or moving projectile can have a magnetic moment so that the force from the solenoidal coils can be maximized when the projectile travels parallel to the magnetic field. Such interaction can be achieved, for example, through the electromagnetic induction of eddy currents in an electrically conductive shell surrounding the payload, or in alternate embodiments may also be achieved by installing strong electromagnets or permanent magnets on the payload, for example, by adding superconducting magnets, and/or through any other suitable modification similar in spirit.

In various embodiments, the payload or other projectile traveling through the acceleration tube can be wrapped in a highly conductive material such as copper, high purity aluminum, or calcium metal, for example. Since calcium metal can have the highest specific conductivity (i.e., per unit weight) of known metals and can be stable within a vacuum environment, such a material can be preferable. In some arrangements, an inner payload or protected component can rest on a flat-faced disc of conductive material or an inverted truncated cone of conductive material, for example. In some arrangements, the payload can be wrapped with a coil of wire made from conductive material. In yet other arrangements, the payload can be cryogenically or evaporatively cooled during acceleration in order to sink the heat generated by eddy currents during the acceleration process.

Various different types of power supplies can be provided for the disclosed systems. Accelerating payloads or moving projectiles can place significant requirements on the energy storage and discharge system. As such, a suitable power supply for the system can be capable of storing between 5-50 times the desired energy to be imparted onto the payload via acceleration. As a specific nonlimiting example for purposes of illustration, for a 100 kg payload, with initial velocity of 686 m/s (initial energy of 23.53 MJ) with desired final velocity of 1029 m/s (final energy 52.94 MJ), the acceleration tube can be arranged to impart 29.41 MJ of energy. Assuming constant acceleration and a tube length of 25 m, for example, this would necessitate a power supply that can store between 147-1470 MJ of energy and release this energy into the coils over the course of several milliseconds. Other weights, tube lengths, power requirements, and other parameters are also possible.

In various embodiments, a suitable power storage system can include a bank of capacitors. Such capacitors can be non-polarized and/or can utilize an active or passive snubber or crowbar circuits to protect non-polarized forms of components. In alternative embodiments, the capacitors can be connected in parallel or supplanted by a compensated-pulsed alternator or compulsator system, flywheel energy storage system, or superconducting magnetic energy storage system ("SMES"), for example. The energy storage system can be charged via a rectified high voltage secondary of a mains transformer, flyback, ZVS, or other capacitor charging power supply, or directly via a large battery bank or other power supply.

In some embodiments, successively lower ESR and lower capacity energy storage devices can be placed physically and/or electrically closer to the primary drive coils to lower the impedance of the primary drive circuit. To discharge the stored electrical, kinetic, electromagnetic, or magnetic energy into the primary drive coils, electrical switches may be placed physically and/or electrically close to the primary drive coils. Such switches can include, for example, gate-turn off ("GTO") thyristors, integrated gate-commutated thyristors ("IGCT"), MOSFET-controlled thyristors ("MCT"), triacs, silicon controlled rectifiers ("SCR"), arc-gapped switches, vacuum tubes such as hydrogen or mercury vapor thyratrons, krytrons, or the like, insulated gate bipolar transistors ("IGBT"), MOSFET, BJT, and/or one of many other suitable semiconductor, vacuum, plasma, mechanical, or superconducting switches, or banks of parallel or series switches arranged in a number of configurations, as will be readily appreciated by those of ordinary skill in the state of the art. In some embodiments, each primary drive coil can be controlled by one set of switches with a freewheel diode and/or snubber resistor placed across a flyback current path. In some arrangements, the diode and snubber can be supplanted or replaced by a second switch or set of switches that can include a half-bridge configuration. Other arrangements are also possible.

In addition to the foregoing, various arrangements of control electronics for the disclosed launch acceleration systems can be provided. Rapid switching on and off of the primary drive coils can be controlled such that the magnetic field is maximized, such as in an identical axial direction to the magnetic field induced or produced by the payload traveling through the tube, such that the overall force between the coils and the payload can be repulsive. This may be preferred since an attractive or reluctance-based configuration (where the axial direction of the magnetic field is opposite) is generally limited by saturation of the ferromagnetic material, and the relaxation time of that ferromagnetic material, thus resulting in suckback of the projectile at higher velocities. An inductance (repulsion-based) accelerator can avoid or mitigate such issues. In some arrangements a sensing system can be directed at creating a net zero magnetic field when the center of the field of the payload or moving projectile has not yet passed the center of the field of the primary drive coils. The sensing system thus can be directed at inducing a maximal magnetic field in both the projectile and the primary drive coils when the center of the field of the payload or projectile is just slightly past the center of the field of the primary drive coils, such that the magnetic field can be minimized when the projectile has left the primary drive coil. This process can then be repeated for each drive coil.

In some embodiments, the sensing system can utilize signals from high-gauge sensing coils located between the primary drive coils and acceleration tube, signals generated by a radar telemetry system, or a laser, light emitting diode, maser, or other high speed electromagnetic feedback system, and/or multiple systems acting in conjunction or signals interpreted by a computer on-the fly to determine the exact position of the moving projectile. The more precisely the control electronic system is able to determine the position of the projectile relative to the primary drive coil, and the faster the control system is able to direct the primary drive coils to induce their magnetic fields, the higher the overall system efficiency will be. It is thus desirable to maximize the speed of switching, speed of sensing, and precision of sensing.

Figure 4:
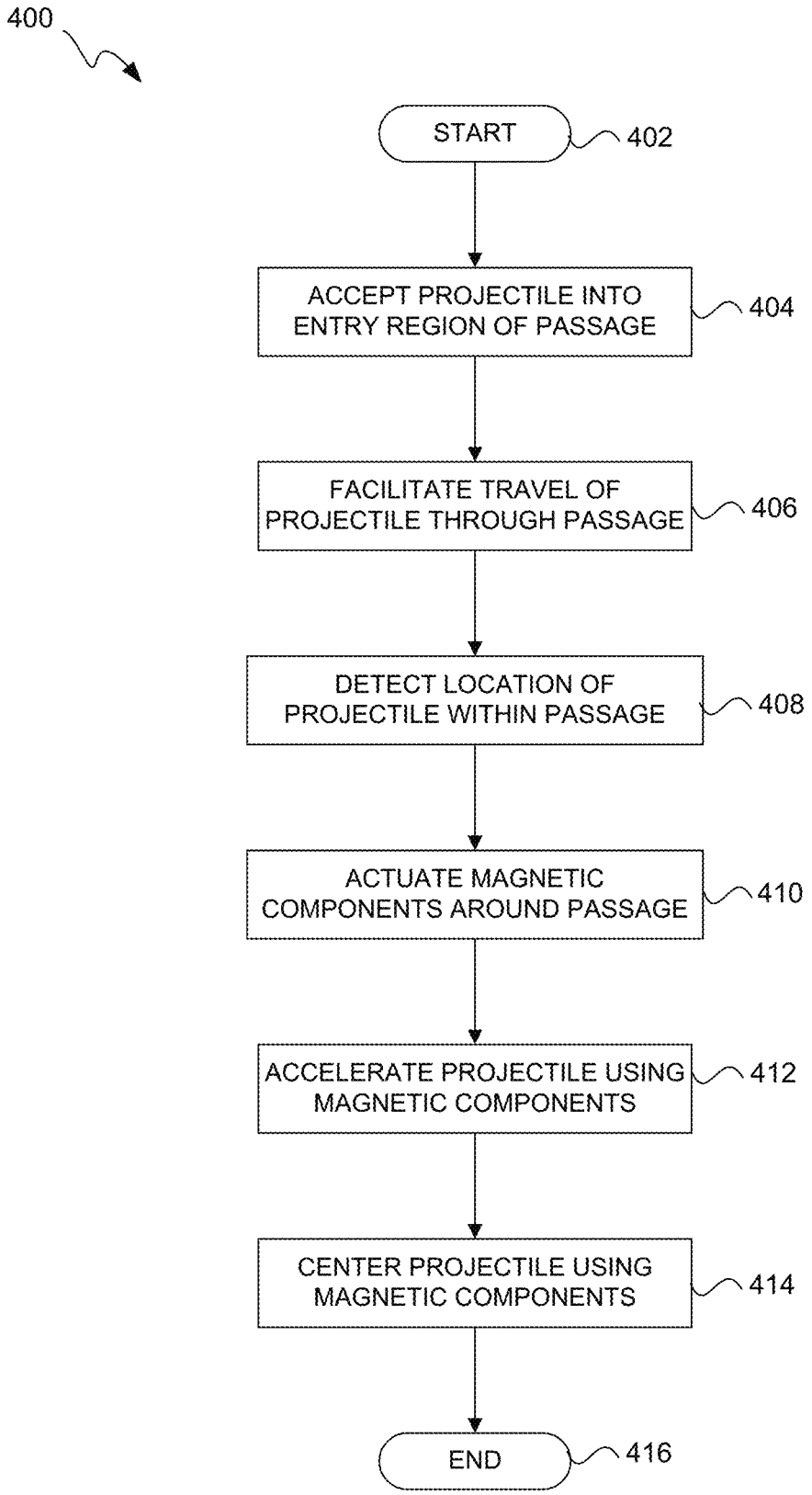
FIG. 4 illustrates a flowchart of an example method of accelerating a moving projectile according to one embodiment of the present disclosure.

Moving lastly to FIG. 4, a flowchart of an example method 400 of accelerating a moving projectile is provided. After a start step 402, a first process step 404 can involve accepting a moving projectile into an entry region of a passage having a projectile acceleration pathway. Such a passage, entry region, and projectile acceleration pathway can be those described in the foregoing embodiments, for example. Such components can be part of a launch acceleration system, which can be a booster system or auxiliary component for a separate initial launch component or system in some arrangements.

A following step 406 can involve facilitating travel of the moving projectile through the passage along the projectile acceleration pathway. At the next process step 408, the location of the moving projectile can be detected while the moving projectile is within the passage. This can involve one or more sensing components, such as those disclosed above, for example.

At a subsequent process step 410, a plurality of magnetic components arranged around the passage or projectile acceleration pathway can be actuated while the moving projectile travels along the projectile acceleration pathway. As noted above, the projectile acceleration pathway can progress straight through the passage. Actuation of the magnetic components can be accomplished according to a particular timing, the determination of which can be aided by way of the detected location and velocity of the projectile.

At the following process step 412, the moving projectile can be accelerated using the actuated magnetic components while the moving projectile travels along the projectile acceleration pathway. As noted above, this can be facilitated by way of magnetic forces generated by actuation of the magnetic components. Acceleration of the moving projectile can also be facilitated due to the projectile having one or more magnetically susceptible portions, as noted above. At a next process step 414, the moving projectile can be centered within the passage using the actuated magnetic components. Again, this can be facilitated by way of magnetic forces generated by actuation of the magnetic components, which can result in pulling the moving projectile toward a center line along a longitudinal axis of the passage. The method can then end at end step 416.

For the foregoing method 400, it will be appreciated that not all process steps are necessary, and that other process steps may be added in some arrangements. Furthermore, the order of steps may be altered in some cases, and some steps may be performed simultaneously. For example, steps 410-414 may be performed simultaneously in some arrangements. In addition, some steps may be repeated. For example, different magnetic components can be actuated separately in sequence as may suitable for optimizing acceleration and centering due to the detected location and velocity of the moving projectile. Although known process steps are provided for the various features and desired outcomes of method 400, it will be appreciated that other steps can also be added and/or substituted. Other variations and extrapolations of the disclosed method 400 will also be readily appreciated by those of skill in the art.

Although the foregoing disclosure has been described in detail by way of illustration and example for purposes of clarity and understanding, it will be recognized that the above described disclosure may be embodied in numerous other specific variations and embodiments without departing from the spirit or essential characteristics of the disclosure. Certain changes and modifications may be practiced, and it is understood that the disclosure is not to be limited by the foregoing details, but rather is to be defined by the scope of the appended claims.

What is claimed is:

1. A system configured to accelerate a moving projectile, the system comprising:

a passage including an entry region, a projectile acceleration pathway, and an exit region, wherein the passage is configured to accept a moving projectile therein at the entry region, allow travel of the moving projectile therethrough along the projectile acceleration pathway, and expel the moving projectile therefrom at the exit region, the moving projectile having at least one magnetically susceptible portion;

a plurality of magnetic components arranged around the projectile acceleration pathway such that the moving projectile travels through the plurality of magnetic components; and a control system coupled to the plurality of magnetic components, the control system including sensing components, switching components, and power components, wherein the control system is configured to actuate the plurality of magnetic components at one or more proper times in order to facilitate one or more applications of magnetic force from the plurality of magnetic components to the moving projectile as the moving projectile passes through the projectile acceleration pathway in a manner that accelerates the moving projectile.

2. The system of claim 1, wherein the passage is in the shape of a tube and the projectile acceleration pathway extends through the tube.

3. The system of claim 2, wherein the plurality of magnetic components forms multiple sets of coils around the tube.

4. The system of claim 1, wherein the projectile acceleration pathway forms a straight line.

5. The system of claim 1, wherein the plurality of magnetic components form a multistage induction coil gun around the passage.

6. The system of claim 1, wherein the plurality of magnetic components form a multistage repulsion coil gun around the passage.

7. The system of claim 1, wherein the control system is further configured to actuate the plurality of magnetic components in a manner that centers the moving projectile within the passage as the moving projectile travels along the projectile acceleration pathway.

8. The system of claim 1, further comprising:

a powering component configured to provide power to the plurality of magnetic components.

9. The system of claim 8, wherein the powering component derives power from a separate component that imparts an initial velocity on the moving projectile prior to the moving projectile entering the passage.

10. The system of claim 1, wherein the passage is configured to have a vacuum therein when the moving projectile passes therethrough.

11. The system of claim 1, wherein the at least one magnetically susceptible portion is formed from a copper, high purity aluminum, or calcium metal material.

12. The system of claim 1, wherein the moving projectile includes an inner region configured to hold a payload therein.

13. A system configured to accelerate a moving projectile, the system comprising:

a passage including an entry region, a projectile acceleration pathway, and an exit region, wherein the passage is configured to accept a moving projectile therein at the entry region, allow travel of the moving projectile therethrough along the projectile acceleration pathway, and expel the moving projectile therefrom at the exit region, the moving projectile having at least one magnetically susceptible portion and an inner region configured to hold a payload therein;

a plurality of magnetic components arranged around the projectile acceleration pathway such that the moving projectile travels through the plurality of magnetic components, wherein the inner region is magnetically shielded from the plurality of magnetic components; and a control system coupled to the plurality of magnetic components, wherein the control system is configured to actuate the plurality of magnetic components at one or more proper times in order to facilitate one or more applications of magnetic force from the plurality of magnetic components to the moving projectile as the moving projectile passes through the projectile acceleration pathway in a manner that accelerates the moving projectile.

14. The system of claim 1, wherein the control system is configured to switch power on and off rapidly to the plurality of magnetic components based on the exact location of the moving projectile in the passage.

15. A system configured to accelerate a moving projectile, the system comprising:

a passage including an entry region, a projectile acceleration pathway, and an exit region, wherein the passage is configured to accept a moving projectile therein at the entry region, allow travel of the moving projectile therethrough along the projectile acceleration pathway, and expel the moving projectile therefrom at the exit region, the moving projectile having at least one magnetically susceptible portion;

a plurality of magnetic components arranged around the projectile acceleration pathway such that the moving projectile travels through the plurality of magnetic components; and a control system coupled to the plurality of magnetic components, wherein the control system includes sensing components configured to detect the exact location and velocity of the moving projectile, and wherein the control system is configured to actuate the plurality of magnetic components at one or more proper times in order to facilitate one or more applications of magnetic force from the plurality of magnetic components to the moving projectile as the moving projectile passes through the projectile acceleration pathway in a manner that accelerates the moving projectile.

16. A method of accelerating a moving projectile, the method comprising:

accepting the moving projectile into an entry region of a passage having a projectile acceleration pathway;

facilitating travel of the moving projectile through the passage along the projectile acceleration pathway;

detecting the location of the moving projectile while the moving projectile is within the passage;

actuating a plurality of magnetic components arranged around the projectile acceleration pathway while the moving projectile travels along the projectile acceleration pathway;

accelerating the moving projectile using the actuated magnetic components while the moving projectile travels along the projectile acceleration pathway; and centering the moving projectile within the passage using the actuated magnetic components.

17. The method of claim 16, wherein accelerating the moving projectile involves imparting a magnetic repulsion force from the magnetic components to a magnetically susceptible portion of the moving projectile.

18. The method of claim 16, wherein facilitating travel of the moving projectile through the passage involves preventing contact between the moving projectile and the passage.

19. The system of claim 1, further comprising:

an initial launch source configured to launch the projectile into the passage.

20. The system of claim 19, wherein the initial launch source is configured to launch the projectile into the passage at an angle that corresponds to the passage entry region.

* * * * *